US011769951B2

(12) United States Patent
Lee et al.

(10) Patent No.: US 11,769,951 B2
(45) Date of Patent: Sep. 26, 2023

(54) ANTENNA APPARATUS AND ELECTRIC DEVICE

(71) Applicant: Samsung Electro-Mechanics Co., Ltd., Suwon-si (KR)

(72) Inventors: Hyungjin Lee, Suwon-si (KR); Woncheol Lee, Suwon-si (KR); Myeong Woo Han, Suwon-si (KR); Jeongki Ryoo, Suwon-si (KR); Youngsik Hur, Suwon-si (KR); Wongi Kim, Suwon-si (KR); Gopal Garg, Fremont, CA (US)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 140 days.

(21) Appl. No.: 17/124,535

(22) Filed: Dec. 17, 2020

(65) Prior Publication Data

US 2022/0085505 A1 Mar. 17, 2022

(30) Foreign Application Priority Data

Sep. 11, 2020 (KR) ..... 10-2020-0117059

(51) Int. Cl.
*H01Q 1/24* (2006.01)
*H01Q 9/04* (2006.01)
*H01Q 21/06* (2006.01)

(52) U.S. Cl.
CPC ..... *H01Q 9/045* (2013.01); *H01Q 21/065* (2013.01); *H01Q 1/243* (2013.01)

(58) Field of Classification Search
CPC ..... H01Q 9/045; H01Q 21/065; H01Q 1/243
See application file for complete search history.

(56) References Cited

U.S. PATENT DOCUMENTS 6,690,331 B2 * 2/2004 Apotolos ..... H01Q 11/14 343/741
7,084,815 B2 * 8/2006 Phillips ..... H01Q 5/40 343/846

(Continued)

FOREIGN PATENT DOCUMENTS

KR 10-1803208 B1 12/2017

OTHER PUBLICATIONS

Stanley, Manoj et al., "A Capacitive Coupled Patch Antenna Array with High Gain and Wide Coverage for 5G Smartphone Applications", *IEEE Access 6*, 2018 (pp. 41942-41954).

*Primary Examiner* — Hai V Tran
*Assistant Examiner* — Bamidele A Jegede
(74) *Attorney, Agent, or Firm* — NSIP Law

(57) ABSTRACT

An antenna apparatus includes antennas, each having first and second feeding portions facing each other across a dielectric layer, and third and fourth feeding portions facing each other across the dielectric layer, and a signal application unit configured to apply a wireless communication signal to the antennas, and including a plurality of output ports, wherein the first and second feeding portions are configured to receive electric signals having a first polarization characteristic, and are respectively connected to first and second output ports that are different from each other among the plurality of output ports, and the third and fourth feeding portions are configured to receive electric signals having a second polarization characteristic that is different from the first polarization characteristic, and are respectively connected to third and fourth output ports that are different from each other among the plurality of output ports.

16 Claims, 6 Drawing Sheets

(56) References Cited

U.S. PATENT DOCUMENTS 8,648,768 B2 * 2/2014 Mussler ..... H01Q 9/0407 343/753
2005/0206568 A1 * 9/2005 Phillips ..... H01Q 5/40 343/700 MS
2006/0007044 A1 * 1/2006 Crouch ..... H01Q 9/0435 343/906
2008/0169992 A1 * 7/2008 Ortiz ..... H01Q 21/065 343/700 MS
2009/0322642 A1 * 12/2009 Foo ..... H01Q 1/42 343/843
2010/0253587 A1 * 10/2010 Lindenmeier ..... H01Q 21/29 343/858
2011/0199279 A1 * 8/2011 Shen ..... H01Q 9/0414 343/700 MS
2012/0214425 A1 * 8/2012 Huang ..... H01Q 1/36 343/893
2015/0194730 A1 * 7/2015 Sudo ..... H01Q 5/378 343/905
2015/0236425 A1 * 8/2015 Sudo ..... H01Q 21/06 343/700 MS
2015/0311589 A1 * 10/2015 Yokoyama ..... H01Q 1/38 343/722
2016/0276734 A1 * 9/2016 Jin ..... H01Q 1/2283
2017/0155185 A1 * 6/2017 Hong ..... H01Q 1/24
2018/0108989 A1 4/2018 De Flaviis et al.
2018/0342789 A1 * 11/2018 Jiang ..... H01Q 21/065
2019/0237851 A1 * 8/2019 Gu ..... H01Q 21/28
2019/0252771 A1 * 8/2019 Yong ..... H01Q 21/22
2019/0327834 A1 * 10/2019 Kim ..... H01Q 21/28
2019/0334224 A1 * 10/2019 Kim ..... H05K 1/0228
2019/0348749 A1 * 11/2019 Thai ..... H01L 23/645
2019/0372229 A1 * 12/2019 Dalmia ..... H01Q 1/2283
2020/0076078 A1 * 3/2020 Tehran ..... H01Q 5/50
2020/0106187 A1 * 4/2020 Ou ..... H01Q 21/067
2020/0106508 A1 * 4/2020 Raghavan ..... H01Q 21/28
2020/0154521 A1 * 5/2020 Nguyen ..... H01Q 21/28
2020/0335851 A1 * 10/2020 Kim ..... H05K 1/0228

* cited by examiner

ANTENNA APPARATUS AND ELECTRIC DEVICE

CROSS-REFERENCE TO RELATED APPLICATIONS

This application claims the benefit under 35 USC 119(a) of Korean Patent Application No. 10-2020-0117059 filed in the Korean Intellectual Property Office on Sep. 11, 2020, the entire disclosure of which is incorporated herein by reference for all purposes.

BACKGROUND

1. Field

The present disclosure relates to an antenna apparatus and an electric device including an antenna apparatus.

2. Description of the Background

Recently, millimeter wave (mmWave) communication including 5th generation communication has been actively researched, and research for commercialization/standardization of an antenna device that smoothly implements it has been actively conducted.

RF signals of high frequency bands, for example, 24 GHz, 28 GHz, 36 GHz, 39 GHz, and 60 GHz are easily lost in a process of being transmitted, thus communication quality may deteriorate.

Meanwhile, as portable electronic devices develop, a size of a screen, which is a display area of the electronic device, increases, and accordingly, a size of the bezel, which is a non-display area in which an antenna and the like are disposed, decreases, such that a size of an area in which the antenna can be installed also decreases.

The above information is presented as background information only to assist with an understanding of the present disclosure. No determination has been made, and no assertion is made, as to whether any of the above might be applicable as prior art with regard to the disclosure.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna apparatus includes a first antenna including a first feeding portion and a second feeding portion facing each other with a first dielectric layer therebetween, and a third feeding portion and a fourth feeding portion facing each other with the first dielectric layer therebetween, a second antenna including a fifth feeding portion and a sixth feeding portion facing each other with a second dielectric layer therebetween, and a seventh feeding portion and an eighth feeding portion facing each other with the second dielectric layer therebetween; and a signal application unit configured to apply a wireless communication signal to the first antenna and the second antenna, and including a plurality of output ports, wherein the first feeding portion and the second feeding portion receive an electric signal of a first polarization characteristic, the first feeding portion and the second feeding portion are respectively connected to a first output port and a second output port that are different from each other among the plurality of output ports, the third feeding portion and the fourth feeding portion receive an electric signal of a second polarization characteristic that is different from the first polarization characteristic, the third feeding portion and the fourth feeding portion are respectively connected to a third output port and a fourth output port that are different from each other among the plurality of output ports, the fifth feeding portion and the sixth feeding portion receive the electric signal of the first polarization characteristic, the fifth feeding portion and the sixth feeding portion are respectively connected to a fifth output port and a sixth output port that are different from each other among the plurality of output ports, the seventh feeding portion and the eighth feeding portion receive the electric signal of the second polarization characteristic, and the seventh feeding portion and the eighth feeding portion are respectively connected to a seventh output port and an eighth output port that are different from each other among the plurality of output ports.

The electric signal of the first polarization characteristic may be an electric signal of a horizontal polarization characteristic, and the electric signal of the second polarization characteristic may be an electric signal of a vertical polarization characteristic.

The first feeding portion and the second feeding portion may be configured to receive a first electric signal and a second electric signal from the signal application unit, and the third feeding portion and the fourth feeding portion may be configured to receive a third electric signal and a fourth electric signal from the signal application unit.

The fifth feeding portion and the sixth feeding portion may be configured to receive a fifth electric signal and a sixth electric signal from the signal application unit, the seventh feeding portion and the eighth feeding portion may be configured to receive a seventh electric signal and an eighth electric signal from the signal application unit, and a strength of the fifth electric signal may be the same as a strength of the first electric signal.

A strength of the first electric signal may be different from a strength of the second electric signal, and a strength of the third electric signal may be different from a strength of the fourth electric signal.

The first antenna and the second antenna may be separated along a first direction and a second direction that is different from the first direction, and an interval between the first antenna and the second antenna measured in the first direction may be different from an interval between the first antenna and the second antenna measured in the second direction.

The first antenna and the second antenna may be dielectric material resonator antennas.

The first antenna and the second antenna may be patch antennas.

In another general aspect, an electric device includes a case including sides and a lower surface connected to the sides, a first antenna disposed at a first side among the sides of the case and including a first feeding portion and a second feeding portion configured to receive an electric signal of a first polarization characteristic, and a third feeding portion and a fourth feeding portion configured to receive an electric signal of a second polarization characteristic that is different from the first polarization characteristic, a second antenna disposed at the lower surface of the case and including a fifth feeding portion and a sixth feeding portion configured to receive an electric signal of the first polarization characteristic, and a seventh feeding portion and an eighth feeding portion configured to receive an electric signal of the second polarization characteristic, and a signal application unit configured to apply a wireless communication signal to the first antenna and the second antenna, and including a plurality of output ports, wherein the first feeding portion, the second feeding portion, the third feeding portion, and the fourth feeding portion are connected to a first output port, a second output port, a third output port, and a fourth output port that are different from each other among the plurality of output ports, and the fifth feeding portion, the sixth feeding portion, the seventh feeding portion, and the eighth feeding portion are connected to a fifth output port, a sixth output port, a seventh output port, and an eighth output port that are different from each other among the plurality of output ports.

The electric device may further include a third antenna, a fourth antenna, and a fifth antenna disposed one by one on a second side, a third side, and a fourth side of the sides of the case.

In another general aspect, an antenna apparatus includes antennas, each including a dielectric layer and feeding portions facing each other in pairs across the dielectric layer in two directions, and a signal application unit configured to independently apply wireless communication signals to each antenna, and having output ports, wherein each feeding portion is connected to a different output port, and wherein each feeding portion in a pair is configured to receive an electric signal of a same polarization characteristic as another feeding portion in the pair, and each pair of feeding portions is configured to receive an electric signal of a different polarization characteristic from another pair of feeding portions disposed in a different direction across the dielectric layer.

In each antenna a pair of feeding portions may be configured to receive an electric signal of a horizontal polarization characteristic, and another pair of feeding portions may be configured to receive an electric signal of a vertical polarization characteristic.

Each feeding portion may be configured to independently receive an electric signal from the signal application unit, and a strength of an electric signal in an antenna may be the same as a strength of another electric signal in another antenna.

An electric device may include a case having sides and a lower surface connected to the sides, and the antenna apparatus, wherein an antenna and another antenna of the antennas of the antenna apparatus may be disposed at a side of the case and at the lower surface of the case, respectively.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
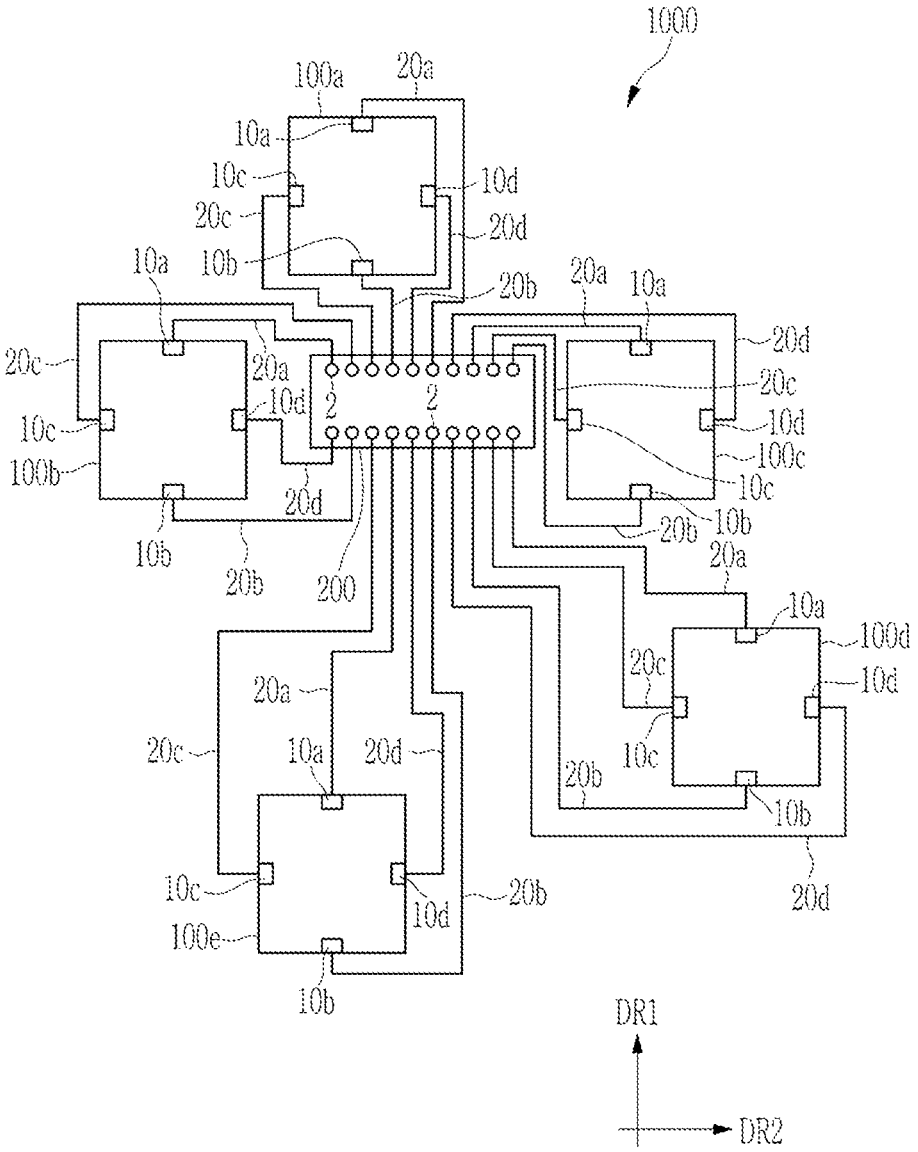
FIG. 1 is a layout view of an antenna apparatus according to one or more example embodiments.

Hereinafter, while examples of the present disclosure will be described in detail with reference to the accompanying drawings, it is noted that examples are not limited to the same.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of this disclosure. For example, the sequences of operations described herein are merely examples, and are not limited to those set forth herein, but may be changed as will be apparent after an understanding of this disclosure, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of this disclosure.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween. As used herein "portion" of an element may include the whole element or less than the whole element.

As used herein, the term "and/or" includes any one and any combination of any two or more of the associated listed items; likewise, "at least one of" includes any one and any combination of any two or more of the associated listed items.

Throughout the specification, the phrase "on a plane" means viewing the object portion from the top, and the phrase "on a cross-section" means viewing a cross-section of which the object portion is vertically cut from the side.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms, such as "above," "upper," "below," "lower," and the like, may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above," or "upper" relative to another element would then be "below," or "lower" relative to the other element. Thus, the term "above" encompasses both the above and below orientations depending on the spatial orientation of the device. The device may also be oriented in other ways (rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

Herein, it is noted that use of the term "may" with respect to an example, for example, as to what an example may include or implement, means that at least one example exists in which such a feature is included or implemented while all examples are not limited thereto.

The features of the examples described herein may be combined in various ways as will be apparent after an understanding of this disclosure. Further, although the examples described herein have a variety of configurations, other configurations are possible as will be apparent after an understanding of this disclosure.

Example embodiments described herein provide an antenna device having improved performance and that is capable of being down-sized, and an electric device including an antenna device having improved performance and that is capable of being down-sized.

Figure 2:
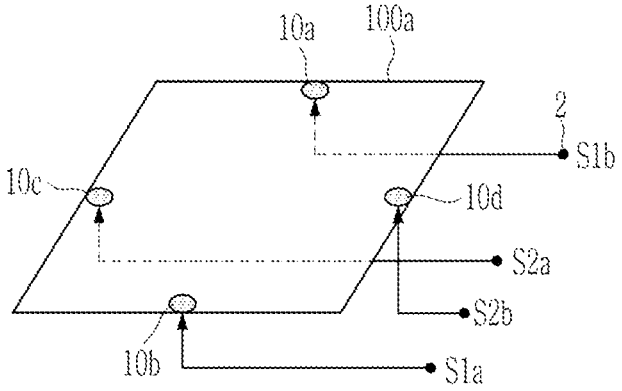
FIG. 2 is a view conceptually showing a part of an antenna apparatus according to one or more example embodiments.

An antenna apparatus 1000 according to one or more example embodiments is described with reference to FIG. 1 and FIG. 2. FIG. 1 is a layout view of an antenna apparatus according to one or more example embodiments, and FIG. 2 is a view conceptually showing a part of an antenna apparatus according to one or more example embodiments.

Referring to FIG. 1, an antenna apparatus 1000 according to one or more example embodiments includes a plurality of antennas 100*a*, 100*b*, 100*c*, 100 *d*, and 100*e*, and a signal application unit 200 connected to the plurality of antennas 100*a*, 100*b*, 100*c*, 100 *d*, and 100*e*.

The signal application unit 200 may be a wireless communication ultra-high frequency chip (RFIC) in which a radio frequency (RF) circuit is integrated on a semiconductor chip.

The plurality of antennas 100*a*, 100*b*, 100*c*, 100 *d*, and 100*e* may include a first antenna 100*a*, a second antenna 100*b*, a third antenna 100*c*, a fourth antenna 100*d*, and a fifth antenna 100*e* spaced from each other. However, the present disclosure is not limited thereto, and the antenna apparatus 1000 may include a different number of antennas.

The first antenna 100*a*, the second antenna 100*b*, the third antenna 100*c*, the fourth antenna 100*d*, and the fifth antenna 100*e* may not be arranged with a line in a certain direction, unlike an array antenna. More specifically, the first antenna 100*a*, the second antenna 100*b*, the third antenna 100*c*, the fourth antenna 100*d*, and fifth antenna 100*e* are separated from each other along a first direction DR1 and a second direction DR2, and intervals between the first antenna 100*a*, the second antenna 100*b*, the third antenna 100*c*, the fourth antenna 100*d*, and the fifth antenna 100*e* according to the first direction DR1 may be different, and intervals measured between the first antenna 100*a*, the second antenna 100*b*, the third antenna 100*c*, the fourth antenna 100*d*, and the fifth antenna 100*e* according to the second direction DR2 may be different.

Accordingly, the arrangement of the first antenna 100*a*, the second antenna 100*b*, the third antenna 100*c*, the fourth antenna 100*d*, and the fifth antenna 100*e* may be easily changed compared to an array antenna in which a plurality of antennas are arranged in a line along a certain direction.

The first antenna 100*a*, the second antenna 100*b*, the third antenna 100*c*, the fourth antenna 100*d*, and the fifth antenna 100*e* each include a plurality of feeding portions 10*a*, 10*b*, 10*c*, and 10*d*.

A first feeding portion 10*a* and a second feeding portion 10*b* of the first antenna 100*a* may be disposed to face each other, and a third feeding portion 10*c* and a fourth feeding portion 10*d* of the first antenna 100*a* may be disposed to face each other. The first feeding portion 10*a* and the second feeding portion 10*b* of the first antenna 100*a* may be spaced apart and disposed to form a predetermined angle with the third feeding portion 10*c* and the fourth feeding portion 10*d* of the first antenna 100*a*. For example, the first feeding portion 10*a* and the second feeding portion 10*b* may be disposed in a direction parallel to the first direction DR1, the third feeding portion 10*c* and the fourth feeding portion 10*d* may be disposed in a direction parallel to second direction DR2, and the second direction DR2 may be perpendicular to the first direction DR1.

The first feeding portion 10*a* of the first antenna 100*a* is connected to one output port 2 of the signal application unit 200 through a first connection line 20*a*, the second feeding portion 10*b* of the first antenna 100*a* is connected to another output port 2 of the signal application unit 200 through a second connection line 20*b*, the third feeding portion 10*c* of the first antenna 100*a* is connected to another output port 2 of the signal application unit 200 through a third connection line 20*c*, and the fourth feeding portion 10*d* of the first antenna 100*a* is connected to another output port 2 of the signal application unit 200 through a fourth connection line 20*d*.

Referring to FIG. 2 along with FIG. 1, among a plurality of feeding portions 10*a*, 10*b*, 10*c*, and 10*d* of the first antenna 100*a*, the first feeding portion 10*a* and the second feeding portion 10*b* that are disposed to face each other and are connected to different output ports 2 of the signal application unit 200 may receive electric signals S1*a* and S1*b* with a first polarization characteristic from the signal application unit 200. The first feeding portion 10*a* of the first antenna 100*a* may receive a first electric signal S1*a* of the first polarization characteristic from the signal application unit 200, and the second feeding portion 10*b* of the first antenna 100*a* may receive a second electric signal S1*b* of the first polarization characteristic from the signal application unit 200. The first electric signal S1*a* and the second electric signal S1*b* may be electric signals with the first polarization characteristic, and the first electric signal S1*a* and the second electric signal S1*b* may be electric signals having different strengths or having the same strengths.

For example, the first feeding portion 10*a* and the second feeding portion 10*b* of the first antenna 100*a* may receive the first electric signal S1*a* and the second electric signal S1*b* with a vertical polarization characteristic, and the first antenna 100*a* may receive and transmit the vertical polarization RF signal through the electric signal applied to the first feeding portion 10*a* and the second feeding portion 10*b*. The first antenna 100*a* may transmit and receive the RF signal according to the electric signal applied to the second feeding portion 10*b* together with the RF signal according to the electric signal applied to the first feeding portion 10*a*, so the gain for the vertical polarization RF signal of the first antenna 100*a* and a bandwidth may increase.

Similarly, the third feeding portion 10*c* and the fourth feeding portion 10*d* disposed to face each other among a plurality of feeding portions 10*a*, 10*b*, 10*c*, and 10*d* of the first antenna 100*a* and connected to different output ports 2 of the signal application unit 200 may receive the electric signals S2*a* and S2*b* with a second polarization characteristic. The third feeding portion 10*c* of the first antenna 100*a* may receive a third electric signal S2*a* of the second polarization characteristic from the signal application unit 200, and the fourth feeding portion 10*d* of the first antenna 100*a* may receive a fourth electric signal S2*b* of the second polarization characteristic from the signal application unit 200. The third electric signal S2*a* and the fourth electric signal S2*b* may be electric signals with the second polarization characteristic, and the third electric signal S2*a* and the fourth electric signal S2*b* may be electric signals having different strengths or the same strengths.

For example, the third feeding portion 10*c* and the fourth feeding portion 10*d* of the first antenna 100*a* may receive the third electric signal S2*a* and the fourth electric signal S2*b* of a horizontal polarization characteristic, and the first antenna 100*a* may receive and transmit the horizontal polarization RF signal through the third electric signal S2*a* and the fourth electric signal S2*b* that are applied to the third feeding portion 10*c* and the fourth feeding portion 10*d*. The first antenna 100*a* may transmit and receive the RF signal according to the electric signal applied to the fourth feeding portion 10*d* together with the RF signal according to the electric signal applied to the third feeding portion 10*c*, so that the gain and the bandwidth for the horizontal polarization RF signal of the first antenna 100*a* may increase.

The first antenna 100*a* includes the first feeding portion 10*a* and the second feeding portion 10*b* receiving the electric signal of the first polarization characteristic, and the third feeding portion 10*c* and the fourth feeding portion 10*d* receiving the electric signal of the second polarization characteristic. The first feeding portion 10*a* and the second feeding portion 10*b* of the first antenna 100*a* receiving the electric signal of the first polarization characteristic may be connected to different output ports 2 of the signal application unit 200 to respectively receive a predetermined electric signal, and the third feeding portion 10*c* and the fourth feeding portion 10*d* of the first antenna 100*a* receiving the electric signal of the second polarization characteristic may be connected to different output ports 2 of the signal application unit 200 to respectively receive a predetermined electric signal. Accordingly, the gain and the bandwidth for the first polarization RF signal of the first antenna 100*a* included in the antenna apparatus 1000 may be increased, and simultaneously, the gain and the bandwidth of the second polarization RF signal of the first antenna 100*a* may be increased.

As described above, the first feeding portion 10*a* and the second feeding portion 10*b* are disposed in a direction parallel to the first direction DR1, and the third feeding portion 10*c* and the fourth feeding portion 10*d* are disposed in a direction parallel to the second direction DR2, and the second direction DR2 may be perpendicular to the first direction DR1. Accordingly, interference between the electric signal of the first polarization characteristic and the electric signal of the second polarization characteristic having the different polarization characteristics may be reduced.

Similar to the first antenna 100*a*, a first feeding portion 10*a*, a second feeding portion 10*b*, a third feeding portion 10*c*, and a fourth feeding portion 10*d* of the second antenna 100*b* are connected to different output ports 2 of the signal application unit 200 through a first connection line 20*a*, a second connection line 20*b*, a third connection line 20*c*, and a fourth connection line 20*d*.

The first feeding portion 10*a* and the second feeding portion 10*b* disposed to face to each other among a plurality of feeding portions 10*a*, 10*b*, 10*c*, and 10*d* of the second antenna 100*b* and connected to different output ports 2 of the signal application unit 200 may receive the electric signal of the first polarization characteristic of the signal application unit 200, and the first feeding portion 10*a* and the second feeding portion 10*b* of the second antenna 100*b* receiving the electric signal of the first polarization characteristic from the signal application unit 200 may respectively receive a predetermined electric signal from the signal application unit 200.

The third feeding portion 10*c* and the fourth feeding portion 10*d* disposed to face to each other among a plurality of feeding portions 10*a*, 10*b*, 10*c*, and 10*d* of the second antenna 100*b* and connected to different output ports 2 of the signal application unit 200 may receive the electric signal of the second polarization characteristic from the signal application unit 200, and the third feeding portion 10*c* and the fourth feeding portion 10*d* of the second antenna 100*b* may respectively receive a predetermined electric signal from the signal application unit 200.

In this way, the second antenna 100*b* includes the first feeding portion 10*a* and the second feeding portion 10*b* receiving the electric signal of the first polarization characteristic and the third feeding portion 10*c* and the fourth feeding portion 10*d* receiving the electric signal of the second polarization characteristic, and the first feeding portion 10*a* and the second feeding portion 10*b* of the second antenna 100*b* receiving the electric signal of the first polarization characteristic may be connected to different output ports 2 of the signal application unit 200 to respectively receive a predetermined electric signal, and the third feeding portion 10*c* and the fourth feeding portion 10*d* of the second antenna 100*b* receiving the electric signal of the second polarization characteristic may be connected to different output ports 2 of the signal application unit 200 to respectively receive a predetermined electric signal.

The second antenna 100*b* may transmit and receive the RF signal according to the electric signal applied to the second feeding portion 10*b* together with the RF signal according to the electric signal applied to the first feeding portion 10*a*, so that the gain and the bandwidth for the first polarization RF signal of the second antenna 100*b* may be increased. In addition, the second antenna 100*b* may transmit and receive the RF signal according to the electric signal applied to the fourth feeding portion 10*d* together with the RF signal according to the electric signal applied to the third feeding portion 10*c*, so that the gain and the bandwidth of the second polarization RF signal of the second antenna 100*b* may be increased.

The first feeding portion 10*a* of the second antenna 100*b* and the first feeding portion 10*a* of the first antenna 100*a* are connected to different output ports 2 of the signal application unit 200, thereby receiving the predetermined electric signals that may be different from or the same as each other. Similarly, the second feeding portion 10*b* of the second antenna 100*b* and the first feeding portion 10*b* of the first antenna 100*a* are connected to different output ports 2 of the signal application unit 200, thereby receiving the predetermined electric signals that may be different from or the same as each other. The third feeding portion 10*c* of the first antenna 100*a* and the third feeding portion 10*c* of the second antenna 100*b* are also connected to different output ports 2 of the signal application unit 200, so that they may receive the predetermined electric signals that may be different from or the same as each other, and the fourth feeding portion 10*d* of the first antenna 100*a* and the fourth feeding portion 10*d* of the second antenna 100*b* are also connected to different output ports 2 of the signal application unit 200, so that they may receive the predetermined electric signals that may be different from or the same as each other.

Similar to the first antenna 100*a* and the second antenna 100*b*, the first feeding portion 10*a*, the second feeding portion 10*b*, the third feeding portion 10*c*, and the fourth feeding portion 10*d* of the third antenna 100*c*, the fourth antenna 100*d*, and the fifth antenna 100*e* are connected to different output ports 2 of the signal application unit 200 through first connection lines 20*a*, second connection lines 20*b*, third connection lines 20*c*, and fourth connection lines 20*d*.

Among a plurality of feeding portions 10*a*, 10*b*, 10*c*, and 10*d* of the third antenna 100*c*, the fourth antenna 100*d*, and the fifth antenna 100*e*, the first feeding portion 10*a* and the second feeding portion 10*b* disposed to face to each other and connected to different output ports 2 of the signal application unit 200 may receive the electric signal with the first polarization characteristic from the signal application unit 200, and the first feeding portion 10*a* and the second feeding portion 10*b* receiving the electric signal of the first polarization characteristic from the signal application unit 200 may respectively receive the predetermined electric signal from the signal application unit 200.

Also, among the plurality of feeding portions 10*a*, 10*b*, 10*c*, and 10*d* of the third antenna 100*c*, the fourth antenna 100*d*, and the fifth antenna 100*e*, the third feeding portion 10*c* and the fourth feeding portion 10*d* disposed to face to each other and connected to different output ports 2 of the signal application unit 200 may receive the electric signal of the second polarization characteristic from the signal application unit 200, and the third feeding portion 10*c* and the fourth feeding portion 10*d* may respectively receive the predetermined electric signal from the signal application unit 200.

In this way, each of the third antenna 100*c*, the fourth antenna 100*d*, and the fifth antenna 100*e* includes a first feeding portion 10*a* and a second feeding portion 10*b* receiving the electric signal of the first polarization characteristic, and a third feeding portion 10*c* and a fourth feeding portion 10*d* receiving the electric signal of the second polarization characteristic, and the first feeding portion 10*a* and the second feeding portion 10*b* receiving the electric signal of the first polarization characteristic may be connected to different output ports 2 of the signal application unit 200 to respectively receive the predetermined electric signal, and the third feeding portion 10*c* and the fourth feeding portion 10*d* receiving the electric signal of the second polarization characteristic may be connected to different output ports 2 of the signal application unit 200 to respectively receive the predetermined electric signal. Therefore, the gain and bandwidth of each first polarization RF signal of the third antenna 100*c*, the fourth antenna 100*d*, and the fifth antenna 100*e* included in the antenna apparatus 1000 may be increased, and simultaneously the gain and bandwidth for each second polarization RF signal of the third antenna 100*c*, the fourth antenna 100*d*, and the fifth antenna 100*e* may be increased.

The antenna apparatus 1000 according to the one or more example embodiments includes a plurality of antennas 100*a*, 100*b*, 100*c*, 100 *d*, and 100*e* and the signal application unit 200 including a plurality of output ports 2 and a plurality of feeding portions 10*a*, 10*b*, 10*c*, and 10*d* of a plurality of antennas 100*a*, 100*b*, 100*c*, 100 *d*, and 100*e* are connected to different output ports 2 among a plurality of output ports 2 of the signal application unit 200, thereby respectively receiving the predetermined electric signal from the signal application unit 200.

Each of a plurality of antennas 100*a*, 100*b*, 100*c*, 100 *d*, and 100*e* of the antenna apparatus 1000 according to the one or more example embodiments includes the first feeding portion 10*a* and the second feeding portion 10*b* connected to the different output ports 2 and respectively receiving the electric signal of the first polarization characteristic of a predetermined strength, and the third feeding portion 10*c* and the fourth feeding portion 10*d* connected to the different output ports 2 and respectively receiving the electric signal of the second polarization characteristic of a predetermined strength. Accordingly, compared with a case that each of a plurality of antennas 100*a*, 100*b*, 100*c*, 100 *d*, and 100*e* includes one feeding portion receiving the electric signal of the first polarization characteristic and one feeding portion receiving the electric signal of the second polarization characteristic, the strength of the electric signal of the first polarization characteristic and the strength of the electric signal of the second polarization characteristic are relatively increased, thereby increasing the gain and bandwidth of the first polarization characteristic and the gain and bandwidth of the second polarization RF signal.

Also, when a plurality of antennas are arranged in an array type and the feeding portions receiving the electric signal of the same polarization characteristic among a plurality of feeding portions of the plurality of antennas are simultaneously connected to one output port so that the electric signals of the same strength are distributed, for example, when two or more first feeding portions among the first feeding portions of the antennas are connected to one output port so that the electric signal of the predetermined strength is distributed to two or more first feeding portions, the strength of the electric signal of the first polarization characteristic applied to each first feeding portion may be smaller than the strength of the electric signal applied as the first feeding portions that are respectively connected to the different output ports like the antenna apparatus 1000 according to the one or more example embodiments. Accordingly, compared with a case that a plurality of feeding portions of a plurality of antennas is connected to one output port to receive the electric signal, the strength of the electric signal of the first polarization characteristic and the electric signal of the second polarization characteristic, which are respectively applied to a plurality of antennas 100*a*, 100*b*, 100*c*, 100 *d*, and 100*e* of the antenna apparatus 1000 according to the one or more example embodiments, may be increased, and accordingly, the gain and bandwidth of the electric signal of the first polarization characteristic and the gain and bandwidth of the second polarization RF signal may be increased, and thus the gain and bandwidth of the antenna apparatus 1000 may be increased.

Also, since each of the plurality of antennas 100*a*, 100*b*, 100*c*, 100 *d*, and 100*e* of the antenna apparatus 1000 according to the one or more example embodiments includes the first feeding portion 10*a* and the second feeding portion 10*b* connected to the different output ports 2 to respectively receive the electric signal of the first polarization characteristic of the predetermined strength, and the third feeding portion 10*c* and the fourth feeding portion 10*d* connected to the different output ports 2 to respectively receive the electric signal of the second polarization characteristic of the predetermined strength, the strength and application period of the electric signal applied to each of the feeding portions 10*a*, 10*b*, 10*c*, and 10*d* of each of the antennas 100*a*, 100*b*, 100*c*, 100 *d*, and 100*e* may be easily adjusted, thereby increasing a degree of freedom in the design of the antenna apparatus 1000.

The antenna apparatus 1000 according to the one or more example embodiments may increase the gain and bandwidth of the first polarization RF signal and the gain and bandwidth of the second polarization RF signal while including a plurality of antennas that are spaced apart from each other without including a plurality of array antennas. Accordingly, the performance of the antenna apparatus 1000 may be improved and it may be down-sized. Therefore, even if the size of a case of an electric device is reduced, the antenna apparatus 1000 may be easily installed in the electric device.

Figure 3:
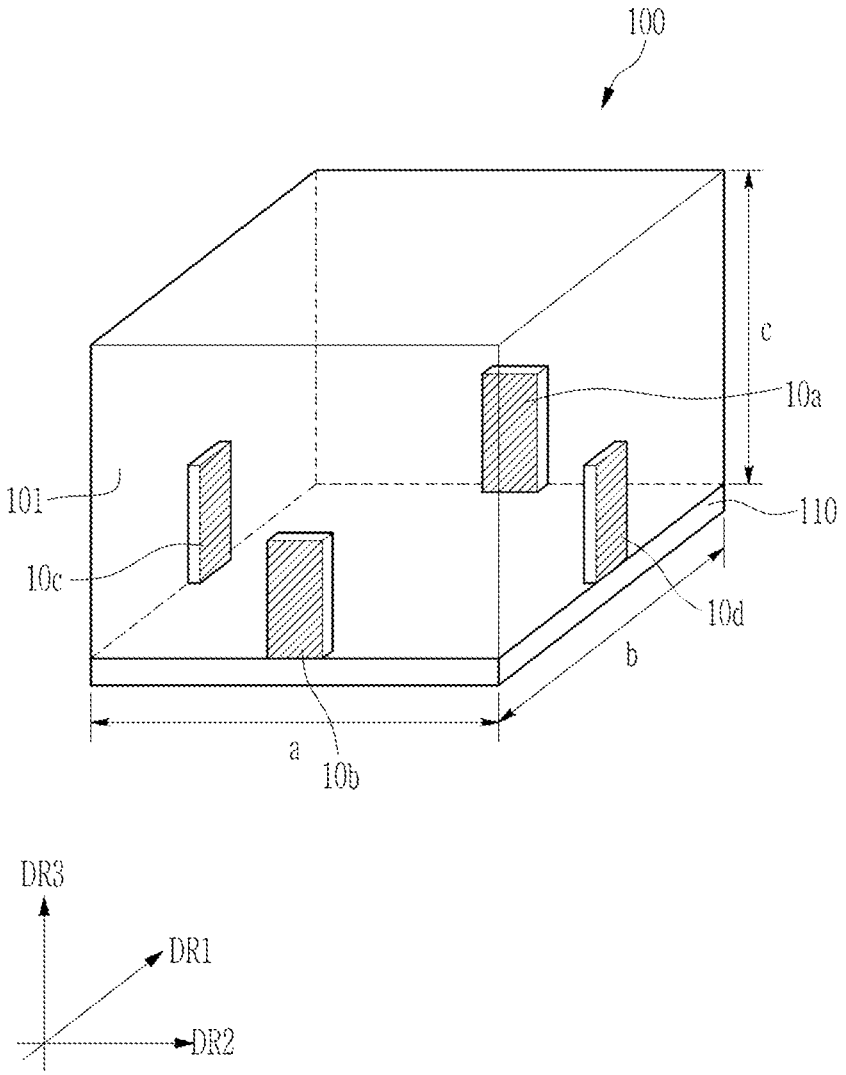
FIG. 3 is a view conceptually showing an example of a structure of an antenna included in an antenna apparatus according to one or more example embodiments.

Next, the structure of the antenna of the antenna apparatus according to one or more example embodiments is described simply with reference to FIG. 3. FIG. 3 is a view conceptually showing an example of a structure of an antenna included in an antenna apparatus according to one or more example embodiments.

Referring to FIG. 3, the antenna 100 according to the shown example embodiment includes a dielectric layer 101 having a cuboid shape having a first length a along the first direction DR1, a second length b along the second direction DR2, and a third length c along the third direction DR3, and the first feeding portion 10*a*, the second feeding portion 10*b*, the third feeding portion 10*c*, and the fourth feeding portion 10*d* for transmitting the electric signal to the dielectric layer 101. A ground layer 110 may be disposed under the dielectric layer 101.

When the electric signal is applied to the first feeding portion 10*a*, the second feeding portion 10*b*, the third feeding portion 10*c*, and the fourth feeding portion 10*d*, a resonance of a certain frequency occurs inside the dielectric layer 101, and the RF signals may be transmitted and received according to the resonance frequency of the antenna 100.

The RF signal may have a format according to Wi-Fi (IEEE 802.11 family, etc.), WiMAX (IEEE 802.16 family, etc.), IEEE 802.20, LTE (long term evolution), Ev-DO, HSPA, HSDPA, HSUPA, EDGE, GSM, GPS, GPRS, CDMA, TDMA, DECT, Bluetooth, 3G, a4G, 5G, and other arbitrary wireless and wired protocols designated later, but is not limited thereto.

The resonance frequency inside the dielectric layer 101 may be determined from a relative dielectric constant value of the dielectric layer 101, a value of the first length a of the first direction DR1 of the dielectric layer 101, a value of the second length b of the second direction DR2, a value of the third length c of the third direction DR3, and propagation constants of axis directions respectively parallel to the first direction DR1 to the third direction DR3.

When the resonance frequency of the antenna 100 according to the present example embodiment is constant, the size of the antenna 100 is proportional to $(e)^{-1/2}$ where the relative dielectric constant value of the dielectric layer 101 is referred to as e. Therefore, when increasing the relative dielectric constant value of the dielectric layer 101, the size of the antenna 100 may be reduced.

The dielectric layer 101 of the antenna 100 according to the present embodiment may have a large dielectric constant, for example, of 1 or more, and more specifically of 10 or more.

The dielectric layer 101 may include at least one of insulating materials of a thermosetting resin such as glass, ceramic, silicone, an epoxy resin, a thermoplastic resin such as a polyimide, or resins of which these resins together with inorganic fillers are impregnated in core materials such as glass fibers (a glass fiber, a glass cloth, a glass fabric, etc.).

As such, since the dielectric layer 101 of the antenna 100 has a large dielectric constant, the predetermined antenna performance may be obtained without increasing the size of the antenna 100.

In addition, the antenna 100 may transmit and receive the RF signal of the first polarization characteristic by receiving the electric signal of the first polarization characteristic from the first feeding portion 10*a* and the second feeding portion 10*b* that are disposed to face each other with the dielectric layer 101 interposed therebetween, and may transmit and receive the RF signal of the second polarization characteristic by receiving the electric signal of the second polarization characteristic from the third feeding portion 10*c* and the fourth feeding portion 10*d* which are disposed to face each other with the dielectric layer 101 interposed therebetween.

Although not shown, the first feeding portion 10*a*, the second feeding portion 10*b*, the third feeding portion 10*c*, and the fourth feeding portion 10*d* may be connected to the different output ports among a plurality of output ports of the signal application unit.

The first feeding portion 10*a* and the second feeding portion 10*b* of the antenna 100 may be connected to the different output ports of the signal application unit to respectively receive the predetermined electric signal, and the third feeding portion 10*c* and the fourth feeding portion 10*d* of the antenna 100 may be connected to the different output ports of the signal application unit to respectively receive the predetermined electric signal. Accordingly, the gain and bandwidth of the first polarization RF signal of the antenna 100 may be increased, and simultaneously, the gain and bandwidth of the second polarization RF signal of the antenna 100 may be increased.

The antenna 100 according to the present example embodiment is the dielectric material resonator antenna and does not use a conductor as a radiating element, so there is no conductor loss in a high frequency region, thereby having a relatively wide bandwidth and high radiation efficiency.

The antenna described with reference to FIG. 3 is an example, and example embodiments are not limited thereto, and for example, an antenna structure including a dielectric material having a large dielectric constant and using the dielectric material as a resonance medium may be applied.

Figure 4:
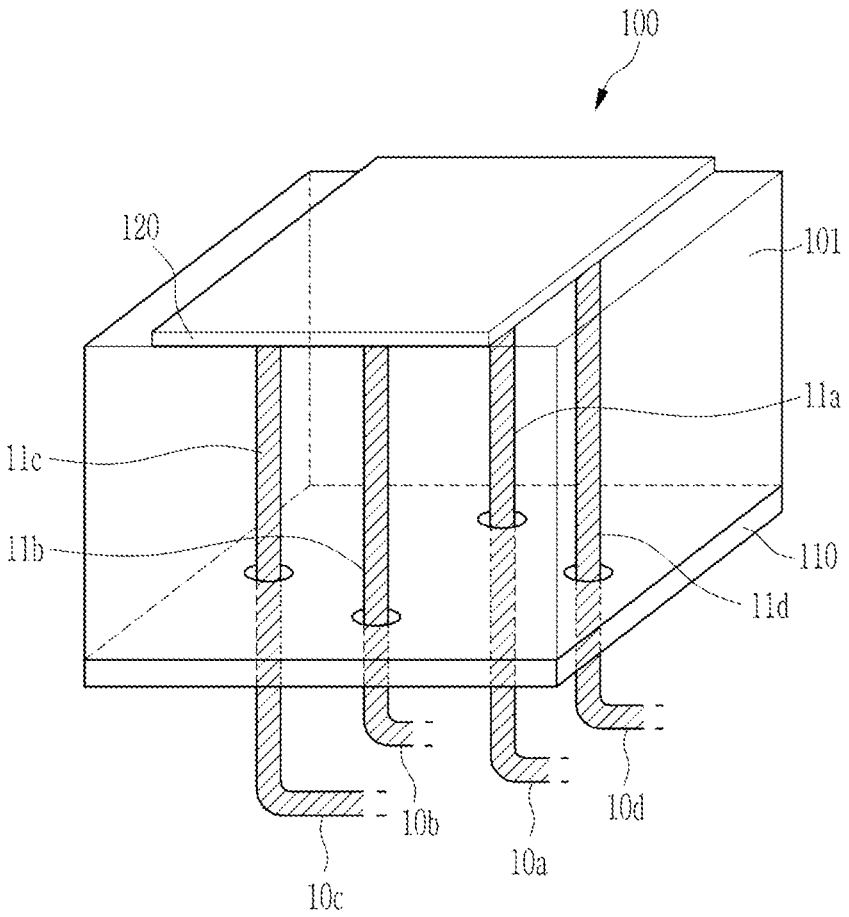
FIG. 4 is a view conceptually showing an example of a structure of an antenna included in an antenna apparatus according to one or more example embodiments.

Now, the structure of the antenna of the antenna apparatus according to another example embodiment is briefly described with reference to FIG. 4. FIG. 4 is a view conceptually showing an example of a structure of an antenna included in an antenna apparatus according to one or more example embodiments.

Referring to FIG. 4, the antenna 100 according to a shown example embodiment includes a patch antenna pattern 120 disposed on a dielectric layer 101, and a first feed via 11*a*, a second feed via 11*b*, a third feed via 11*c*, and a fourth feed via 11*d* for transmitting an electric signal to the patch antenna pattern 120. A ground layer 110 may be disposed under the dielectric layer 101.

The patch antenna pattern 120 may be determined in a plane shape and size according to the frequency characteristic of the antenna 100, which may be changed according to the design of the antenna apparatus.

The ground layer 110 has a plurality of holes, and the first feed via 11*a*, the second feed via 11*b*, the third feed via 11*c*, and the fourth feed via 11*d* may be connected to the first feeding portion 10*a*, the second feeding portion 10*b*, the third feeding portion 10*c*, and the fourth feeding portion 10*d* through the holes formed in the ground layer 110.

When the electric signal is applied to the patch antenna pattern 120 from the first feeding portion 10*a*, the second feeding portion 10*b*, the third feeding portion 10*c*, and the fourth feeding portion 10*d* through the first feed via 11*a*, the second feed via 11*b*, the third feed via 11*c*, and the fourth feed via 11*d*, the patch antenna pattern 120 may transmit and receive the RF signal by the coupling with the ground layer 110.

In the illustrated example embodiment, the first feed via 11*a*, the second feed via 11*b*, the third feed via 11*c*, and the fourth feed via 11*d* are illustrated as being connected to the patch antenna pattern 120, but the example embodiment is not limited thereto, and the first feed via 11*a*, the second feed via 11*b*, the third feed via 11*c*, and the fourth feed via 11*d* may be separated from the patch antenna pattern 120 and may transmit the electric signals by the coupling with the patch antenna pattern 120.

The RF signal may have a format according to Wi-Fi (IEEE 802.11 family, etc.), WiMAX (IEEE 802.16 family, etc.), IEEE 802.20, LTE (long term evolution), Ev-DO, HSPA, HSDPA, HSUPA, EDGE, GSM, GPS, GPRS, CDMA, TDMA, DECT, Bluetooth, 3G, 4G, 5G, and other arbitrary wireless and wired protocols designated later, but is not limited thereto.

The dielectric layer 101 of the antenna 100 according to the present embodiment may have a large dielectric constant, for example, of 1 or more, and more specifically of 10 or more.

The dielectric layer 101 may include at least one of insulating materials of a thermosetting resin such as glass, ceramic, silicone, an epoxy resin, a thermoplastic resin such as a polyimide, or resins of which these resins together with inorganic fillers are impregnated in core materials such as glass fibers (a glass fiber, a glass cloth, a glass fabric, etc.).

As such, since the dielectric layer 101 of the antenna 100 has a large dielectric constant, the predetermined antenna performance may be obtained without increasing the size of the antenna 100.

Also, the antenna 100 may receive the electric signal of the first polarization characteristic from the first feed via 11*a* and the second feed via 11*b* connected to the first feeding portion 10*a* and the second feeding portion 10*b* to transmit and receive the RF signal of the first polarization characteristic, and may receive the electric signal of the second polarization characteristic from the third feed via 11*c* and the fourth feed via 11*d* connected to the third feeding portion 10*c* and the fourth feeding portion 10*d* to transmit and receive the RF signal of the second polarization characteristic.

Although not shown, the first feeding portion 10*a*, the second feeding portion 10*b*, the third feeding portion 10*c*, and the fourth feeding portion 10*d* may be connected to the different output ports among a plurality of output ports of the signal application unit.

The first feeding portion 10*a* and the second feeding portion 10*b* of the antenna 100 may be connected to the different output ports of the signal application unit to respectively receive the predetermined electric signal, and the third feeding portion 10*c* and the fourth feeding portion 10*d* of the antenna 100 may be connected to the different output ports of the signal application unit to respectively receive the predetermined electric signal. Accordingly, the gain and bandwidth of the first polarization RF signal of the antenna 100 may be increased, and simultaneously, the gain and bandwidth of the second polarization RF signal of the antenna 100 may be increased.

The antenna described with reference to FIG. 4 is an example, and example embodiments are not limited thereto, and for example, an antenna structure including a dielectric material having a large dielectric constant and using the dielectric material as a resonance medium may be applied.

Figure 5:
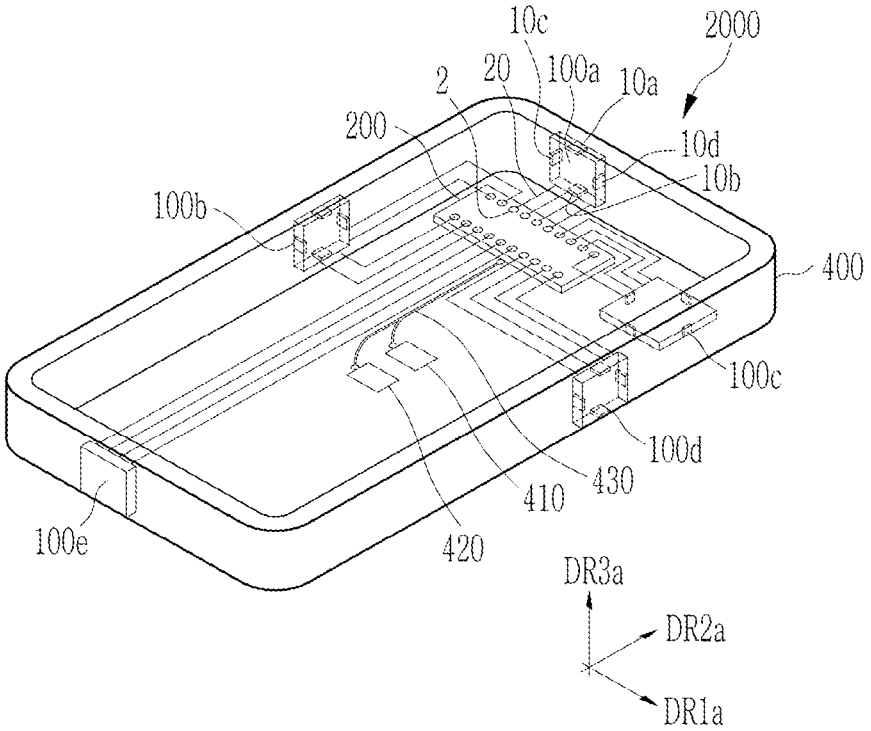
FIG. 5 is a perspective view of an electric device including an antenna apparatus according to one or more example embodiments.

One example of the electric device 2000 including the antenna apparatus according to one or more example embodiments is described with reference to FIG. 5. FIG. 5 is a perspective view of an electric device including an antenna apparatus according to one or more example embodiments.

Referring to FIG. 5, an electric device 2000 according to one or more example embodiments includes an antenna apparatus 1000 described with reference to FIG. 1, and the antenna apparatus 1000 is disposed on a set substrate 400 of the electric device 2000.

As above-described with reference to FIG. 1, the antenna apparatus 1000 of the electric device 2000 includes a plurality of antennas 100*a*, 100*b*, 100*c*, 100 *d*, and 100*e* and the signal application unit 200 including a plurality of output ports 2, and a plurality of feeding portions 10*a*, 10*b*, 10*c*, and 10*d* of a plurality of antennas 100*a*, 100*b*, 100*c*, 100 *d*, and 100*e* may be connected to the different output ports 2 among a plurality of output ports 2 of the signal application unit 200 through connection lines 20 to respectively receive the predetermined electric signal from the signal application unit 200.

The first antenna 100*a*, the second antenna 100*b*, the fourth antenna 100*d*, and the fifth antenna 100*e* of the electric device 2000 may be disposed one by one on four sides of the set substrate 400, and the third antenna 100*c* of the antenna apparatus 1000 may be disposed at the lower surface of the set substrate 400. That is, excluding the upper surface of the electric device 2000 that displays an image among the set substrate 400 of the electric device 2000, one antenna may be respectively disposed on four side surfaces and the lower surface of the electric device 2000. However, this is an example, and the position of the antenna may be changed, for example, the antenna may be disposed on at least one of the four sides of the set substrate 400, and the antenna may be disposed on at least one of the lower and upper surfaces.

The plurality of feeding portions 10*a*, 10*b*, 10*c*, and 10*d* of the plurality of antennas 100*a*, 100*b*, 100*c*, 100*d*, and 100*e* may be respectively connected to the different output ports 2 of the plurality of output ports 2 of the signal application unit 200 to receive the different electric signals from the signal application unit 200.

Each of the plurality of antennas 100*a*, 100*b*, 100*c*, 100 *d*, and 100*e* includes the first feeding portion 10*a* and the second feeding portion 10*b* that receive the electric signal of the first polarization characteristic, and the third feeding portion 10*c* and the fourth feeding portion 10*d* that receive the electric signal of the second polarization characteristic. The first feeding portion 10*a* and the second feeding portion

10*b* receiving the electric signal of the first polarization characteristic may be connected to the different output ports 2 of the signal application unit 200 to receive the electric signal of the same strength as or different strength from each other, and the third feeding portion 10*c* and the fourth feeding portion 10*d* receiving the electric signal of the second polarization characteristic, may be connected to the different output ports 2 of the signal application unit 200 to receive the electric signal of the same strength as or different strength from each other. Therefore, the gain and bandwidth for each first polarization RF signal of a plurality of antennas 100*a*, 100*b*, 100*c*, 100 *d*, and 100*e* may increase, and simultaneously the gain and bandwidth for each second polarization RF signal of a plurality of antennas 100*a*, 100*b*, 100*c*, 100*d*, and 100*e* may be increased.

In addition, the first antenna 100*a*, the second antenna 100*b*, the fourth antenna 100*d*, and the fifth antenna 100*e* of the antenna apparatus 1000 of the electric device 2000 may be disposed one by one on four sides of the set substrate 400, and the third antenna 100*c* of the antenna apparatus 1000 may be disposed on the lower surface of the set substrate 400. Accordingly, the second antenna 100*b* and the fourth antenna 100*d* facing each other along a first direction DR1*a* and disposed on both sides of the set substrate 400 may transmit and receive the RF signal along a direction parallel to the first direction DR1*a*, and the first antenna 100*a* and the fifth antenna 100*e* facing each other along a second direction DR2*a* and disposed on both sides of the set substrate 400 may transmit and receive the RF signal along the direction parallel to the second direction DR2*a*, while the third antenna 100*c* disposed on the lower surface of the set substrate 400 may transmit and receive the RF signal along the direction parallel to the third direction DR3*a*. According to another example embodiment, an antenna may be disposed on only one of both sides of the set substrate 400 facing each other along the first direction DR1*a*, and an antenna may be disposed on only one of both sides of the set substrate 400 facing each other along the second direction DR2*a*. As described above, according to the electric device 2000 including the antenna apparatus 1000 according to one or more example embodiments, without disposing a plurality of array antennas on the sides and lower surface of the set substrate, even if one antenna may be respectively provided on a plurality of surfaces among four sides and lower surface, the gain and bandwidth for the first polarization RF signal and the gain and bandwidth for the second polarization RF signal may be increased. Accordingly, it is possible to down-size the antenna apparatus 1000 included in the electric device 2000, the performance of the antenna apparatus 1000 may be improved, and the transmission and reception capability of the RF signal of the electric device 2000 may be increased.

The electric device 2000 may be a smart phone, a personal digital assistant, a digital video camera, a digital still camera, a smart watch, an automotive part, or the like, however it is not limited thereto.

A communication module 410 and a baseband circuit 420 may be disposed on the set substrate 400, and the antenna apparatus 1000 may be electrically connected to the communication module 410 and the baseband circuit 420 through a coaxial cable 430.

The communication module 410 may include at least one of a memory chip such as volatile memory (e.g., a DRAM), a non-volatile memory (e.g., a ROM), a flash memory, etc. to perform digital signal processing, an application processor chip such as a central processor (e.g., a CPU), a graphics processor (e.g., a GPU), a digital signal processor, an encryption processor, a microprocessor, a microcontroller, a logic chip such as an analog-digital converter, and an application-specific IC (ASIC).

The baseband circuit 420 may generate a base signal by performing analog-digital conversion, amplification of an analog signal, filtering, and frequency conversion. The base signal input to and output from the baseband circuit 420 may be transmitted to the antenna apparatus through a cable. For example, the base signal may be transmitted to the IC through an electrical connection structure, core vias, and wires, and the IC may convert the base signal into the RF signal in the mmWave band.

Each antenna of the antenna apparatus 1000 may include all of the features of the antenna apparatuses according to the example embodiment described above.

Figure 6:
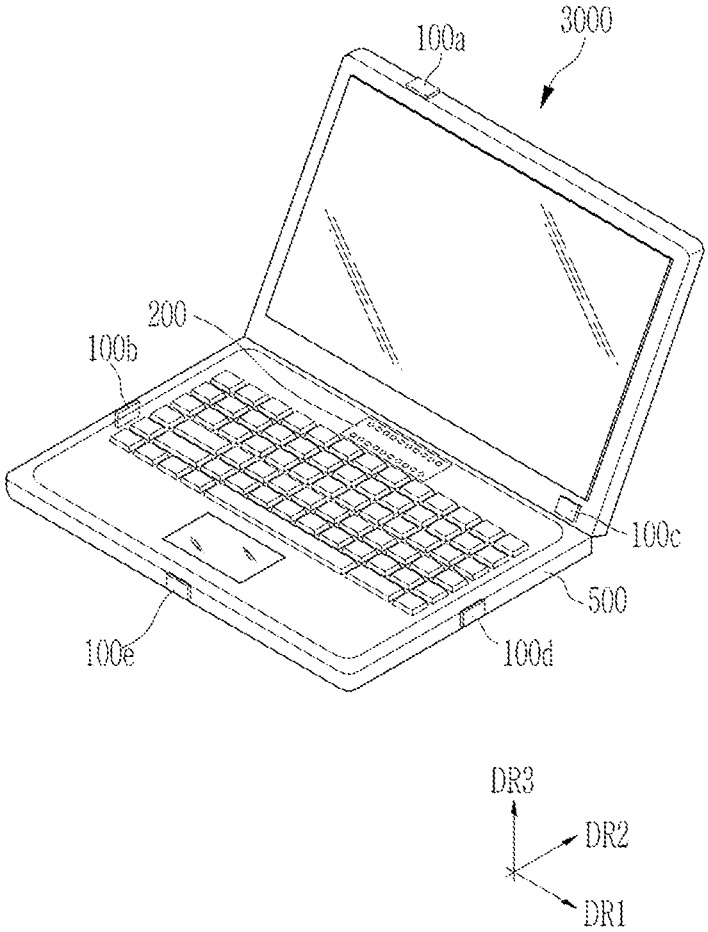
FIG. 6 is a perspective view of an electric device including an antenna apparatus according to one or more example embodiments.

Next, an example of the electric device 3000 including the antenna apparatus according to one or more example embodiments is described with reference to FIG. 6. FIG. 6 is a perspective view of an electric device including an antenna apparatus according to one or more example embodiments.

Referring to FIG. 6, the electric device 3000 according to the example embodiment includes the antenna apparatus 1000 as shown in FIG. 1, and the antenna apparatus 1000 may be disposed in a case 500 of the electric device 3000.

As above-described with reference to FIG. 1, the antenna apparatus 1000 of the electric device 3000 includes a plurality of antennas 100*a*, 100*b*, 100*c*, 100 *d*, and 100*e*, and the signal application unit 200 including a plurality of output ports 2, and a plurality of feeding portions 10*a*, 10*b*, 10*c*, and 10*d* of the plurality of antennas 100*a*, 100*b*, 100*c*, 100 *d*, and 100*e* are connected to different output ports 2 of the plurality of output ports 2 of the signal application unit 200, thereby receiving different electric signals from the signal application unit 200.

The first antenna 100*a*, the second antenna 100*b*, the fourth antenna 100*d*, and the fifth antenna 100*e* of the electric device 3000 are disposed one by one on a plurality of sides of the case 500, and the third antenna 100*c* of the antenna apparatus 1000 is disposed at the lower part of a screen in front of the user.

The plurality of feeding portions 10*a*, 10*b*, 10*c*, and 10*d* of the plurality of antennas 100*a*, 100*b*, 100*c*, 100*d*, and 100*e* may be respectively connected to the different output ports 2 of a plurality of output ports 2 of the signal application unit 200 to receive the different electric signals from the signal application unit 200.

Each of a plurality of antennas 100*a*, 100*b*, 100*c*, 100 *d*, and 100*e* includes the first feeding portion 10*a* and the second feeding portion 10*b* that receive the electric signal of the first polarization characteristic, and the third feeding portion 10*c* and the fourth feeding portion 10*d* that receive the electric signal of the second polarization characteristic. The first feeding portion 10*a* and the second feeding portion 10*b* receiving the electric signal of the first polarization characteristic may be connected to the different output ports 2 of the signal application unit 200 to receive the electric signal of the same strength as or different strength from each other. The third feeding portion 10*c* and the fourth feeding portion 10*d* receiving the electric signal of the second polarization characteristic, may be connected to the different output ports 2 of the signal application unit 200 to receive the electric signal of the same strength as or different strength from each other. Therefore, the gain and bandwidth for each first polarization RF signal of the plurality of antennas 100*a*, 100*b*, 100*c*, 100 *d*, and 100*e* may increase, and simultaneously the gain and bandwidth for each second polarization RF signal of the plurality of antennas 100*a*, 100*b*, 100*c*, 100*d*, and 100*e* may be increased.

In addition, the first antenna 100*a*, the second antenna 100*b*, the fourth antenna 100*d*, and the fifth antenna 100*e* of the electric device 3000 may be disposed one by one on a plurality of sides of the case 500, and the third antenna 100*c* of the antenna apparatus 1000 may be disposed at the lower part of the screen.

Accordingly, the electric device 3000 may transmit and receive the RF signals having directionality in a direction parallel to a direction perpendicular to the surface of a plurality of surfaces in which the plurality of antennas 100*a*, 100*b*, 100*c*, 100 *d*, and 100*e* are disposed one by one, and accordingly, the RF signals may be transmitted and received along various directions.

As described above, the electric device 3000 including the antenna apparatus 1000 according to the example embodiment, without disposing a plurality of array antennas on the sides and lower surfaces of the case 500 of the electric device 3000, even if each antenna is disposed on a plurality of surfaces, the gain and bandwidth for the first polarization RF signal and the gain and bandwidth for the second polarization RF signal may be increased. Accordingly, it is possible to down-size the antenna apparatus 1000 included in the electric device 3000, the performance of the antenna apparatus 1000 may be improved, and the transmission and reception capability of the RF signal of the electric device 3000 may be increased.

The electric device 3000 may be a network system, a computer, a monitor, a tablet, a laptop, a netbook, a television, a video game, etc., however it is not limited thereto.

Although not shown, the communication module and the baseband circuit may be disposed in the case 500, and the antenna apparatus 1000 may be electrically connected to the communication module and the baseband circuit through a coaxial cable.

Each antenna of the antenna apparatus 1000 may include all of the features of the antenna apparatuses according to the example embodiments described above.

The antenna apparatus and the electric device including an antenna apparatus according to example embodiments as described herein, may have improved performance with improved down-sizing compared to conventional technology such as using array antennas.

While specific examples have been shown and described above, it will be apparent after an understanding of this disclosure that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus comprising:

a first antenna comprising a first feeding portion and a second feeding portion facing each other with a first dielectric layer therebetween, and a third feeding portion and a fourth feeding portion facing each other with the first dielectric layer therebetween;

a second antenna comprising a fifth feeding portion and a sixth feeding portion facing each other with a second dielectric layer therebetween, and a seventh feeding portion and an eighth feeding portion facing each other with the second dielectric layer therebetween; and a signal application unit configured to apply a wireless communication signal to the first antenna and the second antenna, and comprising a plurality of output ports, wherein the first feeding portion and the second feeding portion receive an electric signal of a first polarization characteristic, and the first feeding portion and the second feeding portion are respectively connected to a first output port and a second output port that are different from each other among the plurality of output ports, wherein the third feeding portion and the fourth feeding portion receive an electric signal of a second polarization characteristic that is different from the first polarization characteristic, and the third feeding portion and the fourth feeding portion are respectively connected to a third output port and a fourth output port that are different from each other among the plurality of output ports, wherein the fifth feeding portion and the sixth feeding portion receive the electric signal of the first polarization characteristic, and the fifth feeding portion and the sixth feeding portion are respectively connected to a fifth output port and a sixth output port that are different from each other among the plurality of output ports, wherein the seventh feeding portion and the eighth feeding portion receive the electric signal of the second polarization characteristic, and the seventh feeding portion and the eighth feeding portion are respectively connected to a seventh output port and an eighth output port that are different from each other among the plurality of output ports.

2. The antenna apparatus of claim 1, wherein the electric signal of the first polarization characteristic is an electric signal of a horizontal polarization characteristic, and the electric signal of the second polarization characteristic is an electric signal of a vertical polarization characteristic.

3. The antenna apparatus of claim 1, wherein the first feeding portion and the second feeding portion are configured to receive a first electric signal and a second electric signal from the signal application unit, and the third feeding portion and the fourth feeding portion are configured to receive a third electric signal and a fourth electric signal from the signal application unit.

4. The antenna apparatus of claim 3, wherein the fifth feeding portion and the sixth feeding portion are configured to receive a fifth electric signal and a sixth electric signal from the signal application unit, the seventh feeding portion and the eighth feeding portion are configured to receive a seventh electric signal and an eighth electric signal from the signal application unit, and a strength of the fifth electric signal is the same as a strength of the first electric signal.

5. The antenna apparatus of claim 3, wherein a strength of the first electric signal is different from a strength of the second electric signal, and a strength of the third electric signal is different from a strength of the fourth electric signal.

6. The antenna apparatus of claim 1, wherein the first antenna and the second antenna are separated along a first direction and a second direction that is different from the first direction, and an interval between the first antenna and the second antenna measured in the first direction is different from an interval between the first antenna and the second antenna measured in the second direction.

7. The antenna apparatus of claim 1, wherein the first antenna and the second antenna are dielectric material resonator antennas.

8. The antenna apparatus of claim 1, wherein the first antenna and the second antenna are patch antennas.

9. An electric device comprising:

a case comprising sides and a lower surface connected to the sides;

a first antenna disposed at a first side among the sides of the case and comprising a first feeding portion and a second feeding portion configured to receive an electric signal of a first polarization characteristic, and a third feeding portion and a fourth feeding portion configured to receive an electric signal of a second polarization characteristic that is different from the first polarization characteristic;

a second antenna disposed at the lower surface of the case and comprising a fifth feeding portion and a sixth feeding portion configured to receive an electric signal of the first polarization characteristic, and a seventh feeding portion and an eighth feeding portion configured to receive an electric signal of the second polarization characteristic; and a signal application unit configured to apply a wireless communication signal to the first antenna and the second antenna, and comprising a plurality of output ports, wherein the first feeding portion, the second feeding portion, the third feeding portion, and the fourth feeding portion are connected to a first output port, a second output port, a third output port, and a fourth output port that are different from each other among the plurality of output ports, and the fifth feeding portion, the sixth feeding portion, the seventh feeding portion, and the eighth feeding portion are connected to a fifth output port, a sixth output port, a seventh output port, and an eighth output port that are different from each other among the plurality of output ports.

10. The electric device of claim 9, further comprising a third antenna, a fourth antenna, and a fifth antenna disposed one by one on a second side, a third side, and a fourth side of the sides of the case.

11. The electric device of claim 10, wherein the electric signal of the first polarization characteristic is an electric signal of a horizontal polarization characteristic, and the electric signal of the second polarization characteristic is an electric signal of a vertical polarization characteristic.

12. The electric device of claim 11, wherein the first feeding portion and the second feeding portion are configured to receive a first electric signal and a second electric signal from the signal application unit, and the third feeding portion and the fourth feeding portion are configured to receive a third electric signal and a fourth electric signal from the signal application unit.

13. The electric device of claim 12, wherein the fifth feeding portion and the sixth feeding portion are configured to receive a fifth electric signal and a sixth electric signal from the signal application unit, the seventh feeding portion and the eighth feeding portion are configured to receive a seventh electric signal and an eighth electric signal from the signal application unit, and a strength of the fifth electric signal is the same as a strength of the first electric signal.

14. The electric device of claim 12, wherein a strength of the first electric signal is different from a strength of the second electric signal, and a strength of the third electric signal is different from a strength of the fourth electric signal.

15. The electric device of claim 10, wherein the antennas are dielectric material resonator antennas.

16. The electric device of claim 10, wherein the antennas are patch antennas.

* * * * *